US005375553A

United States Patent [19]

Chen

[11] Patent Number: 5,375,553

[45] Date of Patent: Dec. 27, 1994

[54] TRAFFIC CONE

[76] Inventor: Chen S. Chen, P.O. Box 82-144, Taipei, Taiwan, Prov. of China

[21] Appl. No.: 87,523

[22] Filed: Jul. 8, 1993

[51] Int. Cl.[5] ..... E01F 9/10

[52] U.S. Cl. ..... 116/63 C; 116/63 P

[58] Field of Search ..... 116/63 C, 63 P; 220/403, 404

[56] References Cited

U.S. PATENT DOCUMENTS

| | | | |
|---|---|---|---|
| 2,338,604 | 1/1944 | Silveyra | 220/403 |
| 2,987,216 | 6/1961 | Fletcher | 220/404 X |
| 3,052,371 | 9/1962 | Van Bemmelen | 220/404 X |
| 3,487,989 | 1/1970 | Rausing et al. | 220/404 X |
| 3,732,842 | 5/1973 | Vara, Sr. | 116/63 C |
| 3,916,816 | 11/1995 | Fitch | 116/63 P |
| 4,772,869 | 9/1988 | Grammas et al. | 116/63 C |
| 5,195,453 | 3/1993 | McGibbon | 116/63 C |
| 5,211,305 | 5/1993 | Horton | 220/461 |

FOREIGN PATENT DOCUMENTS

| | | | |
|---|---|---|---|
| 2164543 | 3/1986 | United Kingdom | 220/404 |

*Primary Examiner*—William A. Cuchlinski, Jr.
*Assistant Examiner*—Willie Morris Worth
*Attorney, Agent, or Firm*—Alfred Lei

[57] ABSTRACT

This invention relates to a traffic cone and in particular to one which includes a conical body having a top, a flexible bag having an upper mouth, an annular member mounted on the mouth of the flexible bag and having an outer wall and an inner wall between which there is a recessed wall portion adapted to engage the top of the conical body, whereby the flexible bag may be expanded in the conical body to receive water, sand, earth, rock, or the like, so as to enable the conical body to stand firmly on the ground when in use and the traffic cone may be piled up on another one when not in use.

2 Claims, 5 Drawing Sheets

TRAFFIC CONE

BACKGROUND OF THE INVENTION

It has been found that the prior art traffic cone is simply an integral member composed of a rectangular base and a conical body (see FIG. 5). However, such traffic cone is too light in weight and is easily blown down to block the road. Hence, it is proposed to put a waste tire on a traffic cone to increase its weight. Nevertheless, this proposal will increase the transportation cost and make difficult the stowage of the traffic cone and the waste tire.

Therefore, it is an object of the present invention to provide an traffic cone which may obviate and mitigate the above-mentioned drawbacks.

SUMMARY OF THE INVENTION

This invention relates to an improved traffic cone.

It is the primary object of the present invention to provide a traffic cone which may stand firmly on the ground.

It is another object of the present invention to provide a traffic cone which may be piled up on another traffic cone for stowage as well as transportation.

It is still another object of the present invention to provide a traffic cone which is simple in construction.

It is still another object of the present invention to provide a traffic cone which is economic to produce.

It is a further object of the present invention to provide a traffic cone which is practical in use.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Before explaining the present invention in detail, it is to be understood that the invention is not limited in its application to the details of construction and arrangement of parts illustrated in the accompanying drawings, since the invention is capable of other embodiments and of being practiced or carried out in various ways. Also it is to be understood that the phraseology or terminology employed herein is for the purpose of description and not of limitation.

Figure 1:
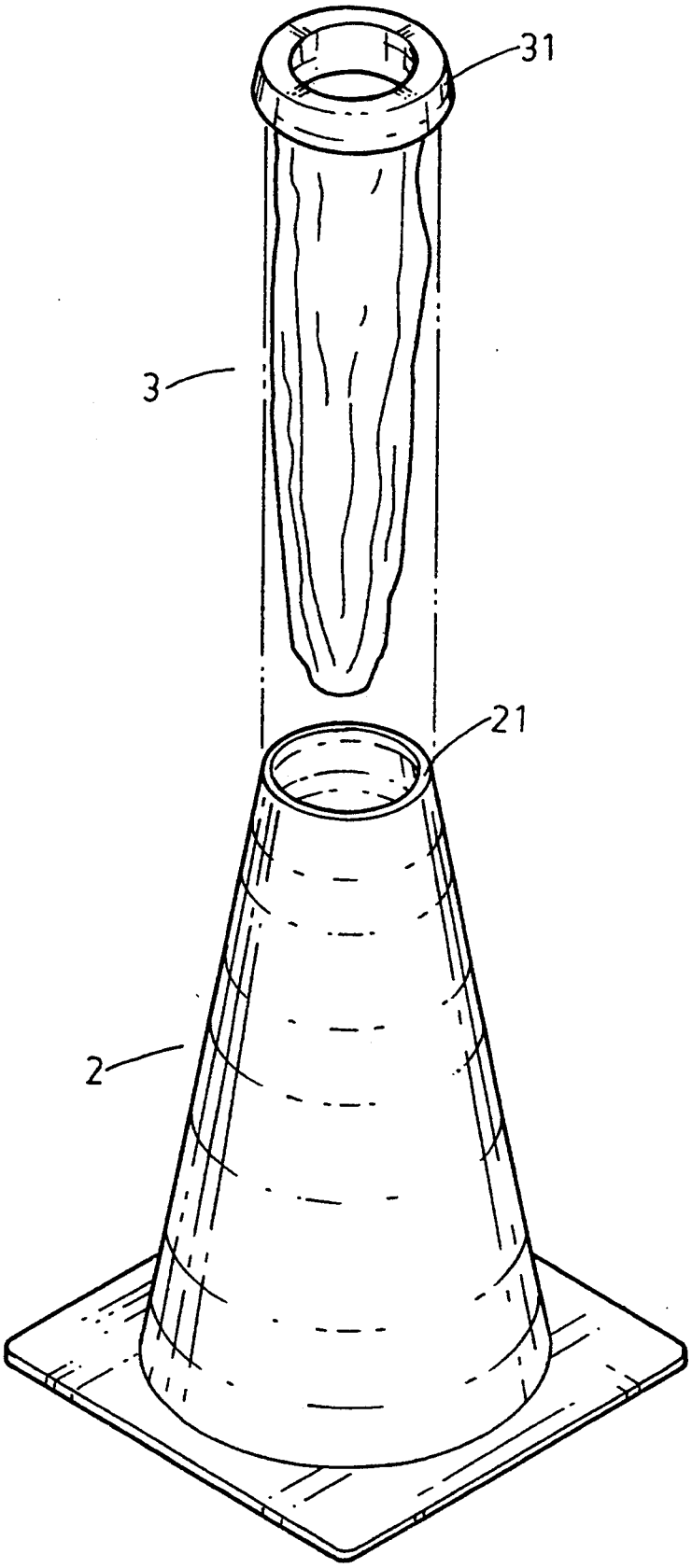
FIG. 1 is an exploded view of a traffic cone according to the present invention.
Figure 2:
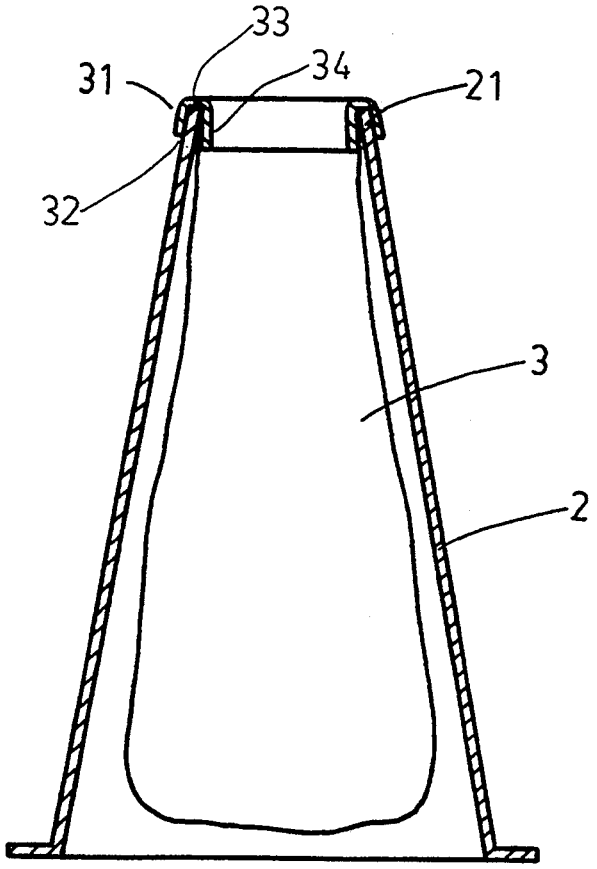
FIG. 2 is a sectional view of the traffic cone.

With reference to the drawings and in particular to FIGS. 1 and 2 thereof, the traffic cone according the present invention mainly comprises a conical body 2 and a bag 3 formed from a flexible material.

Figure 3:
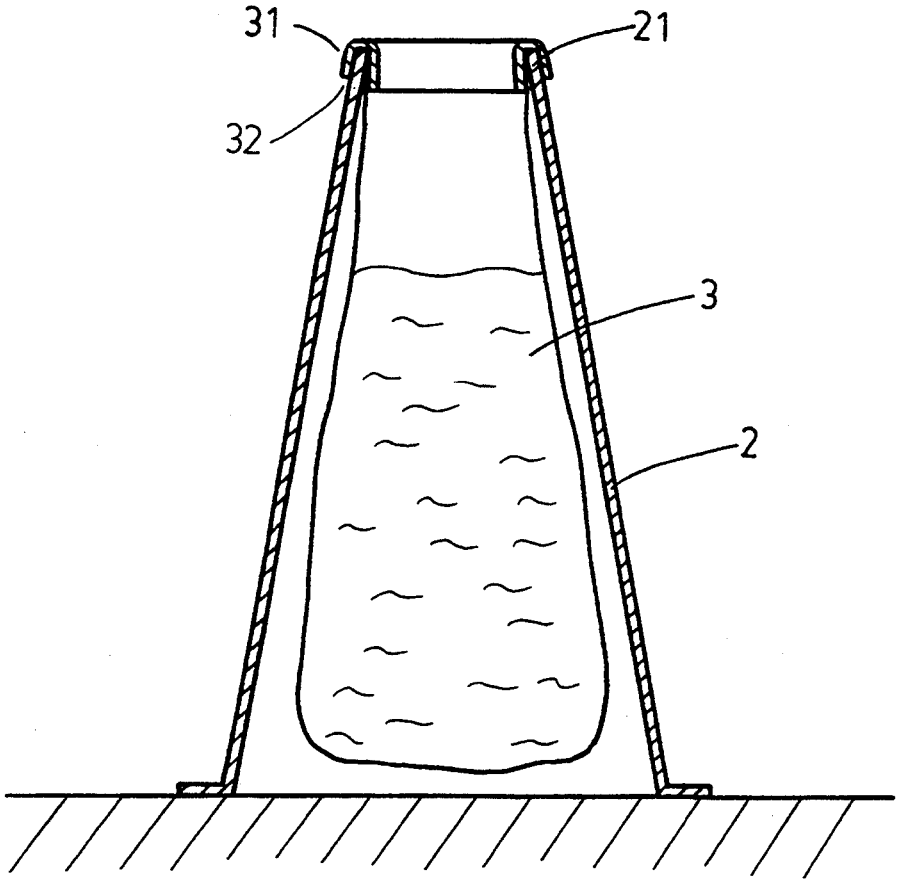
FIG. 3 is a working view of the traffic cone.

As illustrated, the upper portion of the flexible bag 3 has a mouth fixedly connected with an annular ring 31 having an outer wall 32 and an inner wall 34 between which there is a recessed wall portion 33. Hence, the top 21 of the conical body 2 can be engaged with the recessed wall portion 33 of the annular ring 31 so that the flexible bag 3 can be expanded in the conical body 2 for receiving water, sand, earth, rock, or the like (see FIG. 3) when in use. Accordingly, the conical body 2 can be firmly kept in a fixed position.

Figure 4:
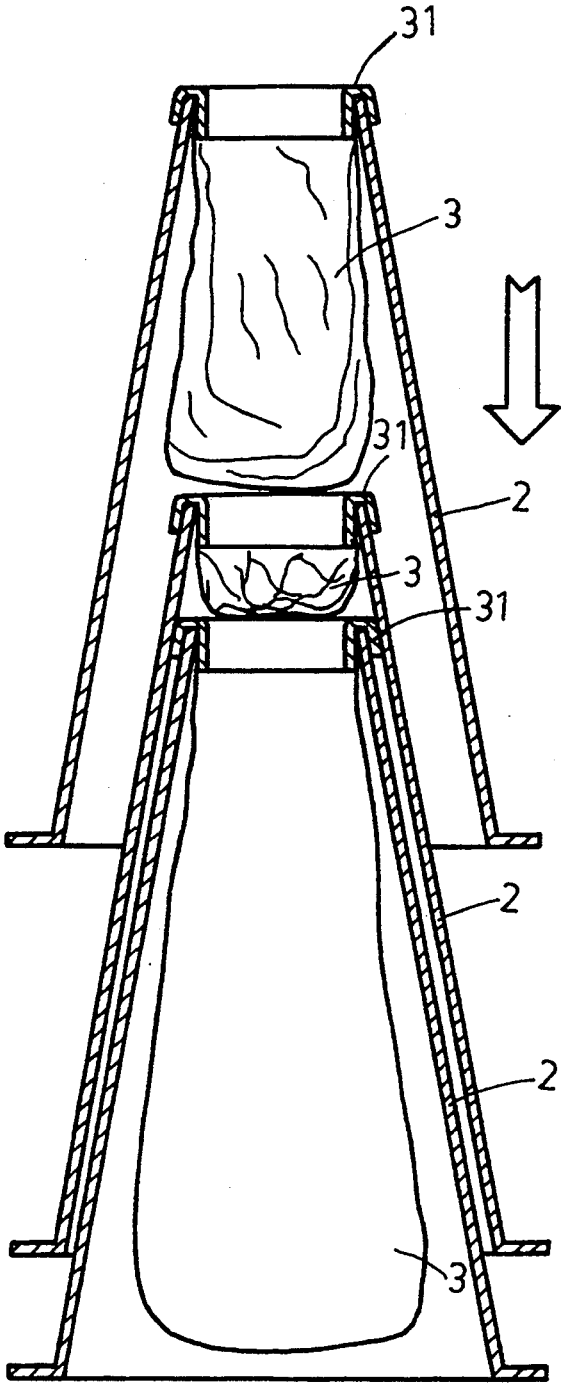
FIG. 4 shows the way to pile up several of the traffic cones together.
Figure 5:
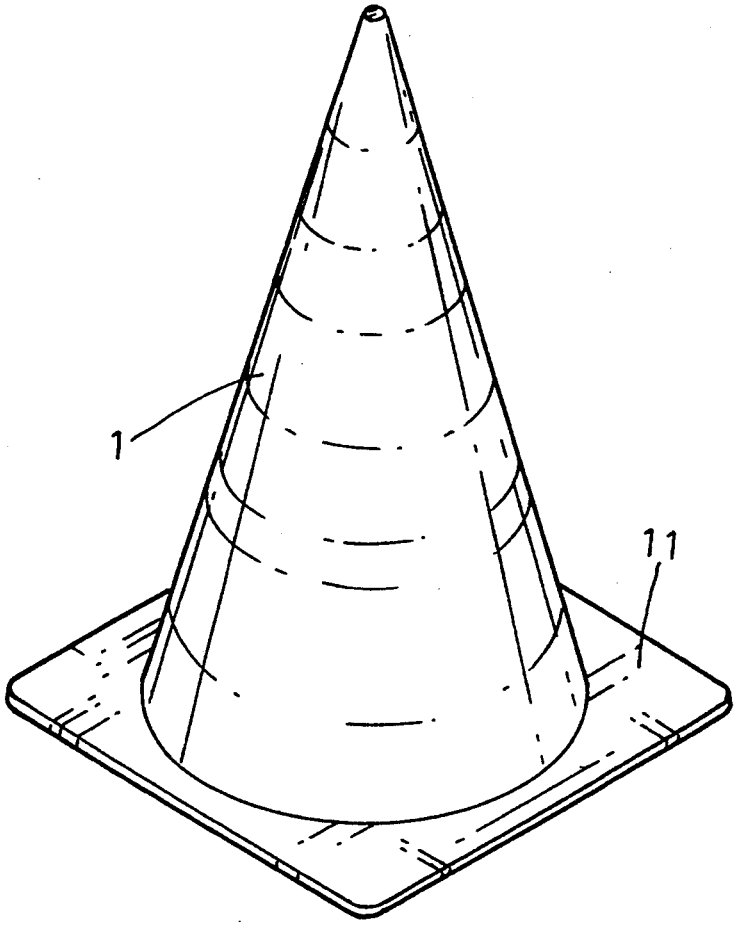
FIG. 5 is a perspective view of a prior art traffic cone.

When not in use, the traffic cones can be piled up as shown in FIG. 4 thereby facilitating stowage as well as transportation.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invent-[on accordingly includes all the means constituting technical equivalents of the means described as well as their combinations.

I claim:

1. A traffic-cone comprising:

a hollow cone-shaped body having open top and bottom ends and tapering towards said open top end;

a bag formed from a flexible material and having an open mouth;

an annular ring-like member affixed to and surrounding the open mouth of the bag;

said ring-like member including an annular outer wall, an annular inner wall and an annular recess therebetween said walls;

said bag being insertable through the open top end of the cone-shaped body and said open top end being receivable within the annular recess of said ring-like member;

whereby when said ring-like member is placed upon the open top end of the cone-shaped body, said bag lies within said cone-shaped body for receipt of means for enabling the cone to stand firmly in a fixed position on the ground insertable through said ring-like member.

2. A traffic cone as claimed in claim 1, wherein said means for enabling the cone to stand firmly comprises one of water, sand, earth and rocks.

* * * * *